United States Patent [19]

Smith

[11] 4,100,518

[45] Jul. 11, 1978

[54] ECCENTRIC CONVERGENCE APPARATUS FOR IN-LINE BEAM CATHODE RAY TUBES

[75] Inventor: Joseph Leland Smith, Indianapolis, Ind.

[73] Assignee: RCA Corporation, New York, N.Y.

[21] Appl. No.: 698,464

[22] Filed: Jun. 21, 1976

[51] Int. Cl.[2] ..... H01J 29/68

[52] U.S. Cl. ..... 335/212

[58] Field of Search ..... 335/210, 211, 212

[56] References Cited

U.S. PATENT DOCUMENTS

| | | | |
|---|---|---|---|
| Re. 27,698 | 7/1973 | Werst | 335/212 |
| 3,290,532 | 12/1966 | Lemke et al. | 335/212 X |
| 3,508,181 | 4/1970 | Melone | 335/212 |
| 3,743,984 | 7/1973 | Takenaka et al. | 335/212 |
| 3,743,985 | 7/1973 | Nishimura et al. | 335/212 |
| 3,793,602 | 2/1974 | Lister | 335/212 |
| 3,889,217 | 6/1975 | Martin et al. | 335/212 |
| 4,045,754 | 8/1977 | Barten | 335/210 X |

FOREIGN PATENT DOCUMENTS 2,608,620 9/1976 Fed. Rep. of Germany.

*Primary Examiner*—A. D. Pellinen

*Attorney, Agent, or Firm*—Eugene M. Whitacre; Paul J. Rasmussen; Joseph Laks

[57] ABSTRACT

Apparatus for moving in any direction a first outer beam of three in-line electron beams within the envelope of a cathode ray tube. A magnetic field producing arrangement is rotationally adjustable about the neck of a cathode ray tube and has an interior zero magnetic field point located between the central and second outer beams. The arrangement effects movement of the first outer beam in any direction with substantially no movement of the two other beams. To converge both of the outer beams onto the central beam, a second magnetic field producing arrangement is provided.

5 Claims, 11 Drawing Figures

ECCENTRIC CONVERGENCE APPARATUS FOR IN-LINE BEAM CATHODE RAY TUBES

This invention relates to static convergence apparatus for in-line beam cathode ray tubes.

Color display systems, such as utilized in color television receivers, include a cathode ray tube in which three electron beams are modulated by color-representative video signals. The beams impinge on respective color phosphor areas on the inside of the tube viewing screen to reproduce a color scene as the beams are deflected to scan a raster. To accurately reproduce a color scene, the three beams must be substantially converged at the screen at all points on the raster. The beams may be converged at points away from the center of the raster by utilizing dynamic convergence methods of self-converging techniques, or a combination of both. Regardless of the methods utilized to achieve convergence while the beams are deflected, some provision must be made to statically converge the undeflected beams at the center of the screen. Static convergence devices are necessary because the effect of tolerances in the manufacture of electron beam guns and their assembly into the cathode ray tube neck frequently results in a static misconvergence condition.

Some static convergence devices converge the outer beams of three in-line beams of a cathode ray tube onto the central beam by means of four and six pole magnetic field assemblies, producing opposite and like movements, respectively, of the outer beams, such as described in U.S. Pat. No. 3,725,831, granted to R. L. Barbin. Individual adjustment of each outer beam is not provided. There also exist magnetic arrangements non-rotatable about the neck of a cathode ray tube, such as U.S. Pat. No. 3,889,217, granted to G. A. Martin and J. W. Lister, which produce net fields in a fixed direction. To produce these fields, a relatively complicated structure of permanent magnets and variable reluctance pole pieces is required. Two such fields, mutually orthogonal, are necessary for individual adjustments of an electron beam.

SUMMARY OF THE INVENTION

Apparatus is provided for moving, in any direction, a first outer beam of three in-line electron beams within the envelope of a cathode ray tube. Magnetic field producing structure is rotationally adjustable about the neck of a cathode ray tube. The structure has a zero magnetic field point located between the central and the second outer beams for effecting movement, in any direction, of the first outer beam with substantially no movement of the two other beams.

DESCRIPTION OF THE INVENTION

Figure 1:
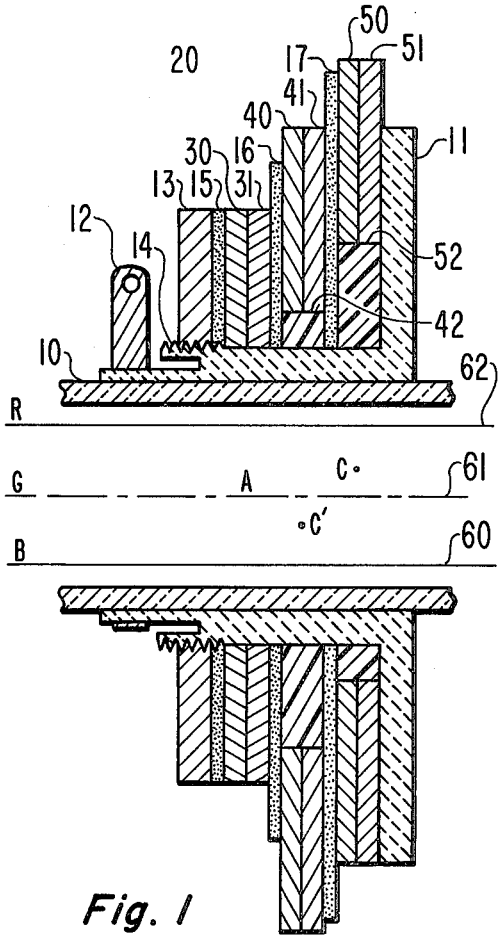
FIG. 1 is a cross-section view of a convergence device embodying the invention.

In FIG. 1, a convergence device 20 comprises a sleeve 11 mounted on a neck portion 10 of a cathode ray tube envelope, not shown. A clamp 12 holds the sleeve 11 tightly against the neck 10.

The undeflected paths of three in-line beams 60, 61 and 62 are shown within the neck 10, corresponding to the electron beams emitted from the blue, green and red guns of a tribeam in-line electron gun arrangement, not shown. The green beam is the one illustratively shown as coincident with the central axis A of the tube. Other in-line arrangements may also be used.

Convergence device 20 includes a pair of magnetic ring members 50 and 51 for moving the blue beam 60 in any direction without substantially moving the other two beams, as will be explained further. The center C of magnetic ring members 50 and 51 is eccentrically located from the central axis A by means of an eccentric collar 52 and is located between the green and red beams 61 and 62. Magnetic ring members 50 and 51 are rotationally adjustable about the neck 10.

Convergence device 20 also includes a pair of magnetic ring members 40 and 41 for moving the red beam 62 in any direction without substantially moving the other two beams. The center C′ of magnetic ring members 40 and 41 is eccentrically located from the central axis A by means of an eccentric collar 42 and is located between the blue and green beams 60 and 61. Magnetic ring members 40 and 41 are rotationally adjustable about the neck 10. A washer 17 separates the two pairs of magnetic ring members 50–51 and 40–41.

Located on sleeve 11 are a pair of rotatable magnetic purity ring members 30 and 31, each of which may be of a conventional two-pole diametrically magnetized, opposite pole design. Rotation of magnetic purity ring members 30 and 31 causes movement of all three of the in-line beams in the same direction.

Magnetic ring members 30 and 31 are separated by a washer 16 from magnetic ring members 40 and 41 and are separated from a locking collar 13 by a washer 15. Locking collar 13 fits over sleeve 11 and mates with the threads 14 to lock all the ring members in position after they are properly adjusted. Any other suitable locking arrangement may also be used.

Figure 2:
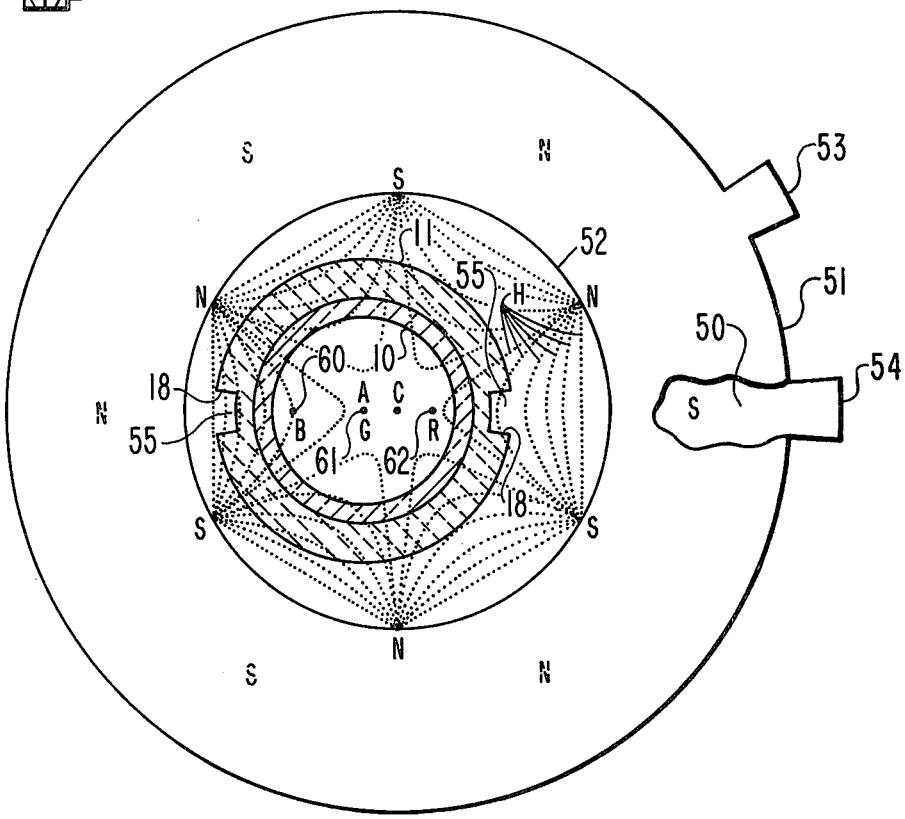
FIG. 2 is a face view of a magnetic beam moving apparatus according to the invention.

FIG. 2 is a face view of a magnetic ring pair 50 and 51 which itself comprises a magnetic beam moving apparatus embodying the invention. Diametrically opposed grooves 18 in sleeve 11 engage corresponding projections 55 of eccentric collar 52 in order to maintain the eccentric collar 52 in a fixed relationship to the sleeve 11. Each ring member 50 and 51 has a tab 54 and 53, respectively, not shown in the drawing of FIG. 1, which permits rotation of the ring members about the neck 10 of the cathode ray tube. The tabs may either be rotated together or one relative to the other. For simplicity, only the magnetic field lines H of ring member 51 is illustrated.

To provide for a desired direction of magnetic force upon an electron beam, the ring members 50 and 51 are rotated together by means of their tabs until the appropriate one of the resultant field lines produced by ring members 50 and 51 is perpendicular to the desired direction of force. The force and the field lines are in the plane of the paper, while the direction of the electron beam travel is normal to the plane of the paper. The well-known right-hand rule may be used to determine the resultant magnetic force direction.

To provide for a desired strength of the magnetic force once a direction has been chosen, the ring members 50 and 51 are rotated one relative to the other. The combined magnetic field is at maximum strength when the tabs are diametrically opposite each other, the north poles being coincident, while the field is at minimum strength when the tabs are together, a north and south pole being coincident. FIG. 2 shows the tabs 53 and 54 at an intermediate position providing for an intermediate magnetic field strength and magnetic force.

The order of ring rotations is not critical and may be reversed, or the rotations may be performed in any order most convenient to the operator. For a six-pole arrangement, such as illustratively shown in FIG. 2, 120° rotation of ring pair 50 and 51 will produce a 360° rotation of an electron beam about its misconverged position on the screen of the cathode ray tube. For any even number of poles, a rotation of 720°/n, where *n* is the number of poles, will produce a 360° rotation of an electron beam about its misconverged position. U.S. Pat. Nos. 3,725,831 and 3,808,570 discuss in greater detail the effects of ring rotation on the strength and direction of the magnetic force. Similar tabs are provided for the ring pair 40 and 41 and the purity ring members 30 and 31.

A first outer beam, shown in the figures as the blue beam, may be moved in any direction by appropriate rotation of first magnetic field producing ring members 50 and 51, with substantially no movement of the other two beams, as will now be explained.

The magnetic field is so formed within each ring as to have a zero magnetic field point at the center C, as shown in FIG. 2. Ring member 50 is shown illustratively with six magnetic poles equiangularly spaced with respect to the center C. Any other pole configuration, such as any even number of equiangularly spaced poles greater than two, which will provide a zero magnetic field point at the center C may also be used. The region around C has relatively weak magnetic fields, while the regions close to the poles have relatively strong magnetic fields.

Figure 3:
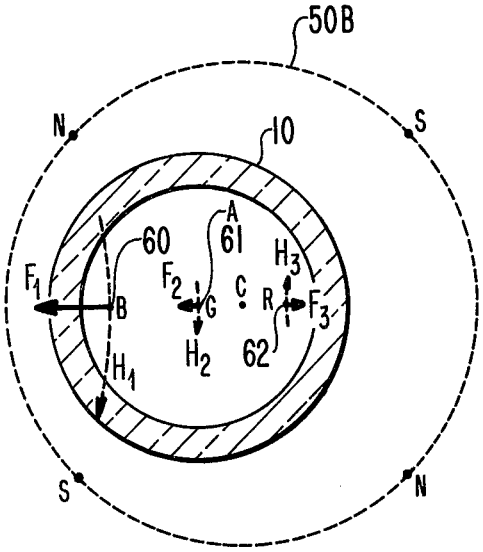
FIGS. 3–6 illustrate the magnetic fields and forces acting upon three in-line beams of a cathode ray tube produced by apparatus embodying the invention.

To effect movement of substantially only the blue beam, the center C is eccentrically located from the central axis A by means of eccentric collar 52. The center C is located between the central green beam 61 and the second outer beam, the red beam 62, as shown schematically in FIG. 3. FIG. 3 shows, for simplicity, the combined magnetic fields of ring members 50 and 51 as a ring 50B with poles so arranged as to produce magnetic field lines $H_1$ and $H_2$ in a downward direction through beams 60 and 61 and field line $H_3$ in an upward direction through beam 62. For simplicity, only a four-pole ring is shown.

$H_1$ produces a horizontal force $F_1$ on the blue beam 60 and moves it to the left. Because the green and red beams 61 and 62 are much closer to the zero magnetic field point C than is the blue beam 60, they are located in a region of relatively weak magnetic fields. The forces $F_2$ and $F_3$ are relatively small and no substantial movement of the green and red beams results. The blue beam 60, being in a region of relatively strong magnetic fields, undergoes substantial movement in a direction determined by appropriate rotation of ring 50B.

Figure 4:
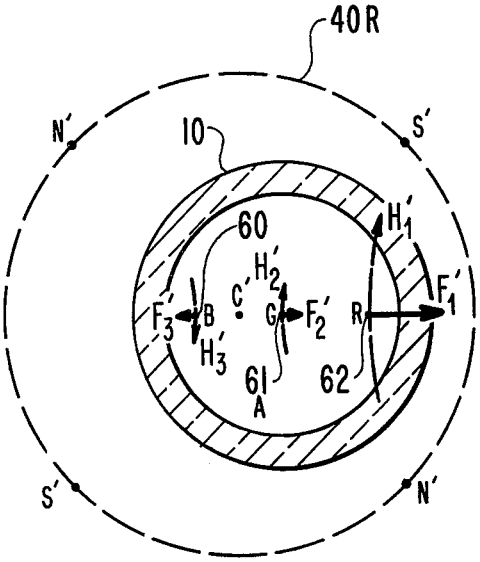

A second magnetic field producing arrangement, illustrated in FIG. 1 as ring members 40 and 41, operate in a similar manner as ring members 50 and 51 but move only the red beam. In the simplified drawing of FIG. 4, eccentric collar 42 locates the zero magnetic field point C′ between the blue and green beams 60 and 61. The combined magnetic fields of ring members 40 and 41 of FIG. 1 are shown schematically as a ring 40R in FIG. 4 with poles so arranged as to produce magnetic field lines $H_1'$ and $H_2'$ in an upward direction through beams 62 and 61 and field line $H_3'$ in a downward direction through beam 60. The forces $F_2'$ and $F_3'$ are relatively small, while the force $F_1'$ is relatively large, thus providing for movement of the red beam with substantially no movement of the blue and green beams.

Figure 5:
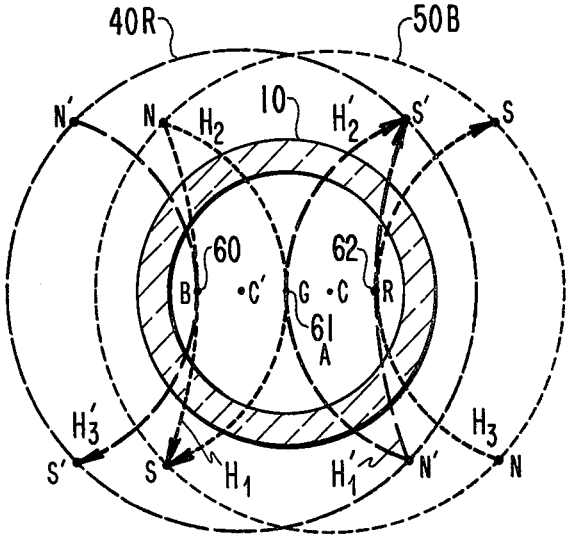
Figure 6:
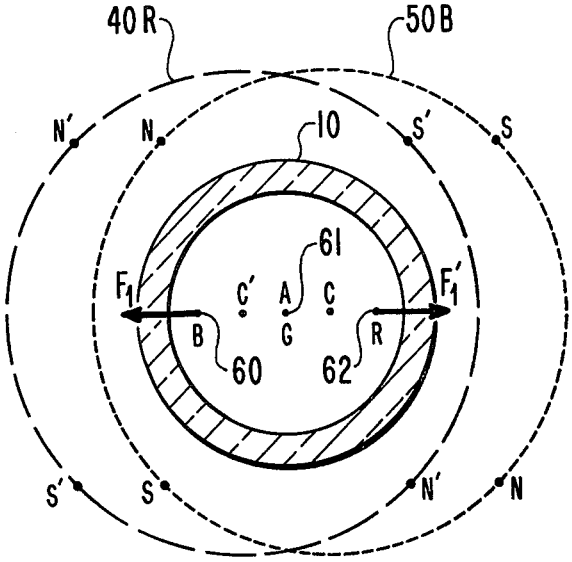

The combined operation of both ring pairs is shown schematically in FIGS. 5 and 6. FIG. 5 shows the combined magnetic fields acting upon the three beams but disregards their field strengths. FIG. 6 takes into account the relatively weak fields around each of the ring pair centers and shows only the significant forces $F_1$ and $F_1'$ providing independent movement of the blue and red beams 60 and 62, respectively. It should be noted that the direction and strength shown for each of the forces in FIG. 6 is illustrative only and, by rotation of the rings 40R and 50B, forces $F_1$ and $F_1'$ may be independently provided any appropriate direction and strength.

Figure 7:
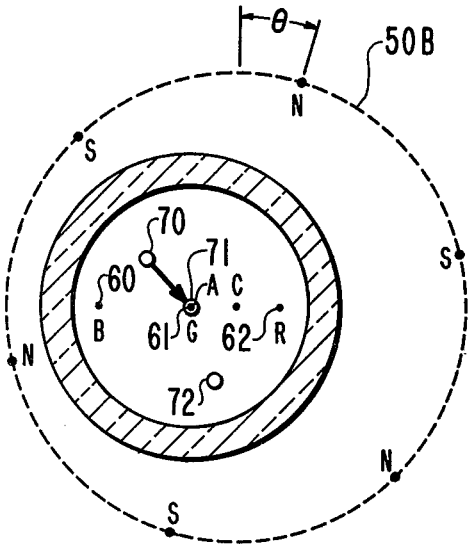
FIGS. 7–8 illustrate a method of convergence using an apparatus embodying the invention.
Figure 8:
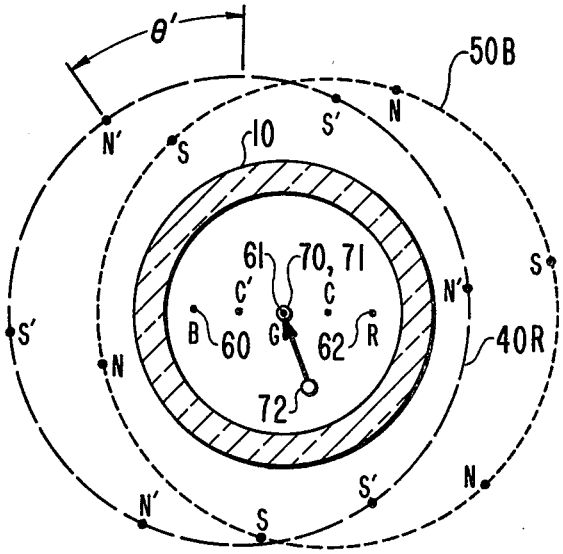

FIGS. 7 and 8 illustrate a method for static convergence adjustment using an embodiment of the invention. In a typical misconverged condition, blue beam 60 has landed on the phosphor screen of a cathode ray tube at position 70 and the red beam 62 has landed in the positon 72. The green beam 61 is shown for convenience to have landed in position 71 on the central axis A. This latter result may be achieved after convergence by appropriate rotation of the purity ring members 30 and 31, if necessary.

To establish the initial condition, ring members 50 and 51 and 40 and 41 are initially oriented by having a diametrically opposite pair of north and south poles lying on a vertical axis in the drawings with the north pole being at the 12 o'clock position. Blue beam 70 is converged onto the central axis A by appropriate rotation of ring members 50 and 51, shown in FIG. 7 as the combined ring 50B. Using the right-hand rule, rotation of ring 50B through an angle $\theta$ from its vertical position will produce a force on blue beam 70, moving the beam onto the central axis A.

Red beam 72 is now converged onto the central axis A by appropriate rotation of ring members 40 and 41, shown in FIG. 8 as the combined ring 40R. Using the right-hand rule, rotation of ring 40R through an angle $\theta'$ from its vertical position will produce a force on red beam 72, moving the beam onto the central axis A. If any slight misconvergence still remains, it may be corrected by repeating the above as necessary. A simple and straightforward procedure readily adaptable to assembly line operation has thus been described.

Figure 9:
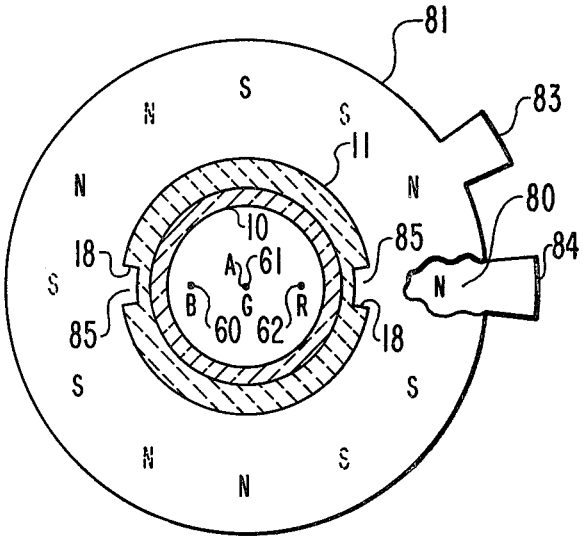
Fig. 9 Prior Art
FIG. 9 is a face view of a concentrically located magnetic apparatus used in a prior art convergence device which may be used in a convergence device embodying the invention.

FIG. 9 illustrates other apparatus which may be included in another static convergence device embodying the invention. Magnetic ring members 40 and 41 and eccentric collar 42 are replaced by concentrically located magnetic ring members 80 and 81 including their respective rotation tabs 83 and 84. The center of each ring member is on the central axis A.

Ring members 80 and 81 are so magnetized as to produce like direction forces on the outer two electron beams 60 and 62. This result may be achieved, as shown in FIG. 9, by placing six magnetic poles of alternating polarity around each ring periphery, producing a hexapolar field, symmetrical about the central axis A. Rotating a concentric hexapolar field by means of ring members 80 and 81 produces like direction movement of the outer beams 60 and 62. This effect is more fully described in U.S. Pat. No. 3,725,831 and 3,808,570. Other arrangements, such as 10, 14-pole ring members or $4n + 2$ pole ring members, wherein $n$ is a positive integer, may also be used.

Figure 10:
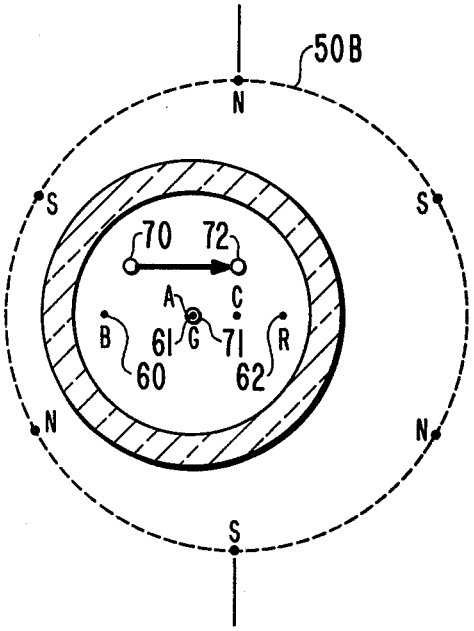
FIGS. 10–11 illustrate a method of convergence using another apparatus embodying the invention.
Figure 11:
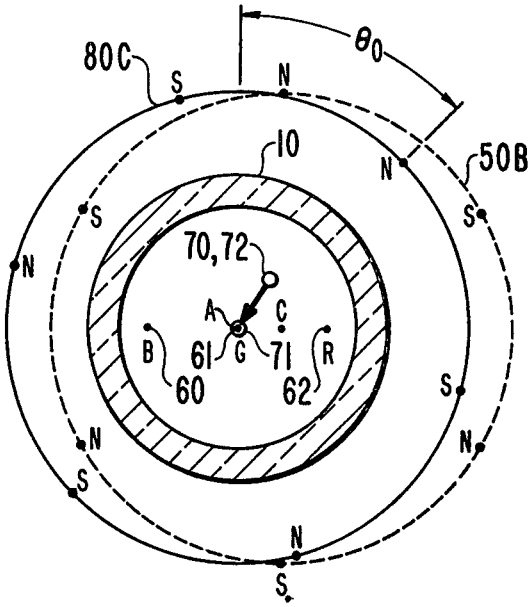

With eccentrically located ring members 50 and 51 and concentrically located ring members 80 and 81, convergence of the outer beams onto the central beam may be achieved, as shown in FIGS. 10 and 11. Blue beam 70 is converged onto red beam 72 by appropriate rotation of ring members 50 and 51, shown as a combined ring 50B in FIG. 10. Next, both beams 70 and 72 are converged onto the central beam 71, here shown illustratively as being on the central axis A. This result is accomplished by the appropriate rotation of ring members 80 and 81, shown in FIG. 11, as rotation of the combined ring 80C through an angle $\theta_0$ from its vertical position. This rotation provides for like direction movement of the outer beams 70 and 72 onto the central beam 71. Movement of all three converged beams onto the center of the cathode ray tube viewing screen, if necessary, is accomplished by rotation of the purity ring members 30 and 31 of FIG. 1.

Eccentrically located magnetic field producing arrangements illustrated as ring members 40, 41, 50 and 51 or, rings 40R and 50B, have been shown as having a four or six-pole configuration. It should be noted that other configurations, which provide for an interior zero magnetic field point, may also be used. Two factors regarding the number of poles used should be considered. First, the greater the number of poles, the weaker the overall field strength. A weaker field will produce a smaller force than may be desired and a lesser movement of an outer beam. On the other hand, the greater the number of poles, the larger the magnetic field gradient as one traverses the field from center to pole. This means that the ratio of desired outer beam movement to undesired movement of the other two beams increases as the number of poles increases. This provides for increased ease of adjustment.

It should be understood that each of the magnetic rings mentioned above may itself be of a nonmagnetic material and have individual magnets appropriately affixed thereto or may be made of a magnetizable material, such as barium ferrite or other suitable material, and magnetized with the appropriate pole configuration. Barium ferrite has the advantage that its permeability is close to one so that it will not greatly affect the fringe fields of the deflection yoke near which it may be placed.

What is claimed is:

1. Magnetic means for converging three in-line electron beams within the envelope of a cathode ray tube, comprising:

a first plurality of magnetic poles placed about a peripheray of said envelope, said first plurality rotatable about at least part of said periphery for effecting movement of a first outer beam in any direction, said first plurality with a first zero magnetic field point eccentrically located from the central axis of said envelope, said first zero magnetic field point located substantially closer to the central and second outer beams than said first outer beam for maintaining substantially no movement of said central and said second outer beams during rotation of said first plurality; and a second plurality of magnetic poles concentrically placed about a periphery of said envelope for effecting like movement of said outer beams in any direction, both of said pluralities combined for converging said outer beams onto said central beam.

2. A convergence device for moving the outer beams of three in-line electron beams within the envelope of a cathode ray tube, comprising:

first magnetic field producing means rotatable about at least a part of a circumference of said envelope for effecting movement of said first outer beam in any direction, said first magnetic field producing means including a first zero magnetic field point located within said envelope between the central beam and the second outer beam for maintaining substantially no movement of said central and second outer beams during rotation of said first magnetic field producing means; and second magnetic field producing means concentrically located and rotatable about at least a part of a circumference of said envelope for effecting movement of both of said outer beams in any direction while maintaining substantially no movement of said central beam during rotation of said second magnetic field producing means, said first and second means combined for converging said outer beams onto said central beam.

3. A convergence device according to claim 2 wherein said first and second magnetic field producing means each comprise a pair of six pole ring members.

4. A convergence device according to claim 2 wherein said second magnetic field producing means effecting like movement of both of said outer beams, said first and second means combined for converging said outer beams onto said central beam.

5. A convergence device according to claim 4 wherein said second magnetic field producing means developing a hexapolar field pattern symmetrically located with respect to said central beam.

* * * * *